US008920009B2

(12) United States Patent
Park

(10) Patent No.: US 8,920,009 B2
(45) Date of Patent: Dec. 30, 2014

(54) LAMP DEVICE FOR VEHICLE

(75) Inventor: Gun woo Park, Yongin-si (KR)

(73) Assignee: Hyundai Mobis Co., Ltd, Yongin-Si, Gyeonggi-Do (KR)

( * ) Notice: Subject to any disclaimer, the term of this patent is extended or adjusted under 35 U.S.C. 154(b) by 186 days.

(21) Appl. No.: 13/555,500

(22) Filed: Jul. 23, 2012

(65) Prior Publication Data

US 2013/0094232 A1 Apr. 18, 2013

(30) Foreign Application Priority Data

Oct. 13, 2011 (KR) ..... 10-2011-0104730

(51) Int. Cl.
*F21V 7/00* (2006.01)
*F21S 8/10* (2006.01)

(52) U.S. Cl.
CPC ..... *F21S 48/1311* (2013.01); *F21S 48/137* (2013.01); *F21S 48/1376* (2013.01); *F21S 48/1382* (2013.01); *F21S 48/1388* (2013.01)
USPC ..... 362/516; 362/517; 362/514; 362/487; 362/341; 362/296.01

(58) Field of Classification Search
CPC ..... F21S 48/10; F21S 48/115; F21S 48/1358; F21S 48/1145; F21S 8/12; F21S 48/1305; F21S 8/10; F21S 48/1382; F21S 48/1323; F21S 48/1388; F21S 48/1163; F21S 48/1258; F21S 48/1104; B60Q 1/04; B60Q 1/0035; F21V 7/00; F21V 13/04; F21V 7/0025; F21V 13/12
USPC ..... 362/538, 516, 509, 517, 514, 487, 341, 362/249.02, 612, 311.02, 507, 296.01, 518, 362/327, 346, 293
See application file for complete search history.

(56) References Cited

U.S. PATENT DOCUMENTS

| | | | | |
|---|---|---|---|---|
| 2004/0141330 | A1* | 7/2004 | Takada | 362/516 |
| 2006/0209552 | A1* | 9/2006 | Okada et al. | 362/509 |
| 2007/0285939 | A1* | 12/2007 | Tachibana | 362/509 |
| 2008/0259625 | A1* | 10/2008 | Noyori et al. | 362/507 |
| 2008/0285297 | A1* | 11/2008 | Ishida | 362/539 |
| 2011/0170308 | A1* | 7/2011 | Kinoshita et al. | 362/516 |
| 2011/0261576 | A1* | 10/2011 | Uchida | 362/512 |
| 2012/0051078 | A1* | 3/2012 | Kinoshita | 362/538 |

FOREIGN PATENT DOCUMENTS

| | | |
|---|---|---|
| JP | 2003-338209 | 11/2003 |
| JP | 2004-220989 | 8/2004 |
| JP | 2009-211853 | 9/2009 |
| JP | 2010-123301 | 6/2010 |

* cited by examiner

*Primary Examiner* — Nimeshkumar Patel
*Assistant Examiner* — Kevin Quarterman
(74) *Attorney, Agent, or Firm* — Sherr & Jiang, PLLC

(57) ABSTRACT

Disclosed is a lamp device for a vehicle, which includes: a lens disposed on a first optical axis extending to a front and a rear of the vehicle; a main reflector disposed at a rear side of the lens, reflecting light frontward, and including a first focus on the first optical axis; a light source disposed on the first focus, and emitting light; a lower sub reflector disposed below the light source, upwardly reflecting the light, and including a first focus on a point at which the first optical axis and a second optical axis extending above and below the vehicle intersect; an upper sub reflector disposed above the light source, and frontwardly reflecting the light reflected by the lower sub reflector; and a shield plate disposed between the lens and the light source, and disposed to correspond to a second focus of the main reflector.

18 Claims, 5 Drawing Sheets

10

LAMP DEVICE FOR VEHICLE

CROSS-REFERENCE TO RELATED APPLICATIONS

The present application claims priority to Korean Patent Application Number 10-2011-0104730 filed Oct. 13, 2011, the entire contents of which application is incorporated herein for all purposes by this reference.

TECHNICAL FIELD

The present invention relates to a lamp device for a vehicle, and more particularly, to a lamp device for a vehicle that improves light efficiency and short-range lateral visibility.

BACKGROUND

In general, when the illuminance of the surroundings is low while driving, a vehicle is equipped with a lamp device to reliably secure the field of vision of the driver or alert other vehicles of the driven state of the vehicle.

A lamp device for a vehicle includes a headlamp installed at the front of the vehicle, and a rear lamp installed at the rear of the vehicle. The headlamp is a lamp that emits light to illuminate the front when driving at night. The rear lamp includes a brake light that lights up when the driver presses the brake, and a turn signal light that indicates the direction in which the vehicle will travel.

While various light sources are being used as light sources of lamp devices for vehicles, the LED light source has recently begun to see wide use because of the low power consumption and the good light efficiency thereof.

In general, the performance of a lamp device for a vehicle is determined on the basis of whether the light efficiency is high or low, and related art lamp devices have the problem of reduced light efficiency due to limitations in the use of a reflective mirror at a lower end by means of a shield plate.

SUMMARY

The present invention has been made in an effort to provide a lamp device for a vehicle that improves visibility for a driver by using an additional reflector.

Objects of the present invention are not limited to the objects described above, and other objects that are not described will be clearly understood by a person skilled in the art from the description below.

An exemplary embodiment of the present invention provides a lamp device for a vehicle, including: a lens disposed on a first optical axis extending to a front and a rear of the vehicle, and refracting and transmitting light; a main reflector disposed at a rear side of the lens, reflecting light frontward, and including a first focus on the first optical axis; a light source disposed on the first focus, and emitting light; a lower sub reflector disposed below the light source, upwardly reflecting the light emitted from the light source, and including a first focus on a point at which the first optical axis and a second optical axis extending above and below the vehicle intersect; an upper sub reflector disposed above the light source, and frontwardly reflecting the light reflected by the lower sub reflector; and a shield plate disposed between the lens and the light source, and disposed to correspond to a second focus of the main reflector, wherein the first focus of the lower sub reflector is disposed apart to the front more than the first focus of the main reflector.

Details of other exemplary embodiments are included in the detailed description and the drawings.

According to the lamp device for a vehicle of the present invention, one or more of the following effects may be realized.

First, there is the advantage of improving light efficiency by using an added optical system with multiple focuss.

Second, there is the advantage of saving energy by increasing light efficiency with a single light source.

Third, there is the advantage of improving visibility by increasing short-range lateral light width.

The effects of the present invention are not limited to the effects described above, and a person of ordinary skill in the art will clearly understand other effects that are not described from the description of the scope of the claims.

DETAILED DESCRIPTION

Figure 1:
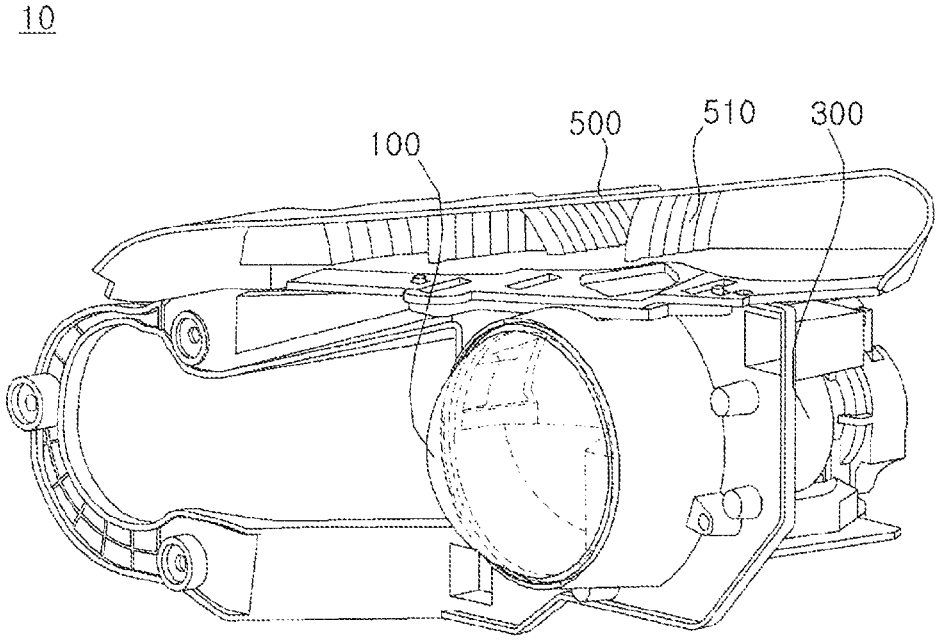
FIG. 1 is a perspective view of a lamp device for a vehicle according to an exemplary embodiment of the present invention.

The advantages and characteristics of the present invention and methods for achieving the same will become clear from the embodiments set forth in detail below with reference to the attached drawings. However, the present invention is not limited to the embodiments set forth below, and may be embodied in various other forms. The present embodiments are for rendering the description of the present invention complete and are set forth to provide a complete understanding of the scope of the invention to a person with ordinary skill in the technical field to which the present invention pertains, and the present invention will only be defined by the scope of the claims. Like reference numerals represent like elements throughout the specification.

Hereinafter, a lamp device 10 for a vehicle according to exemplary embodiments of the present invention will be described in more detail with reference to the drawings.

Figure 2:
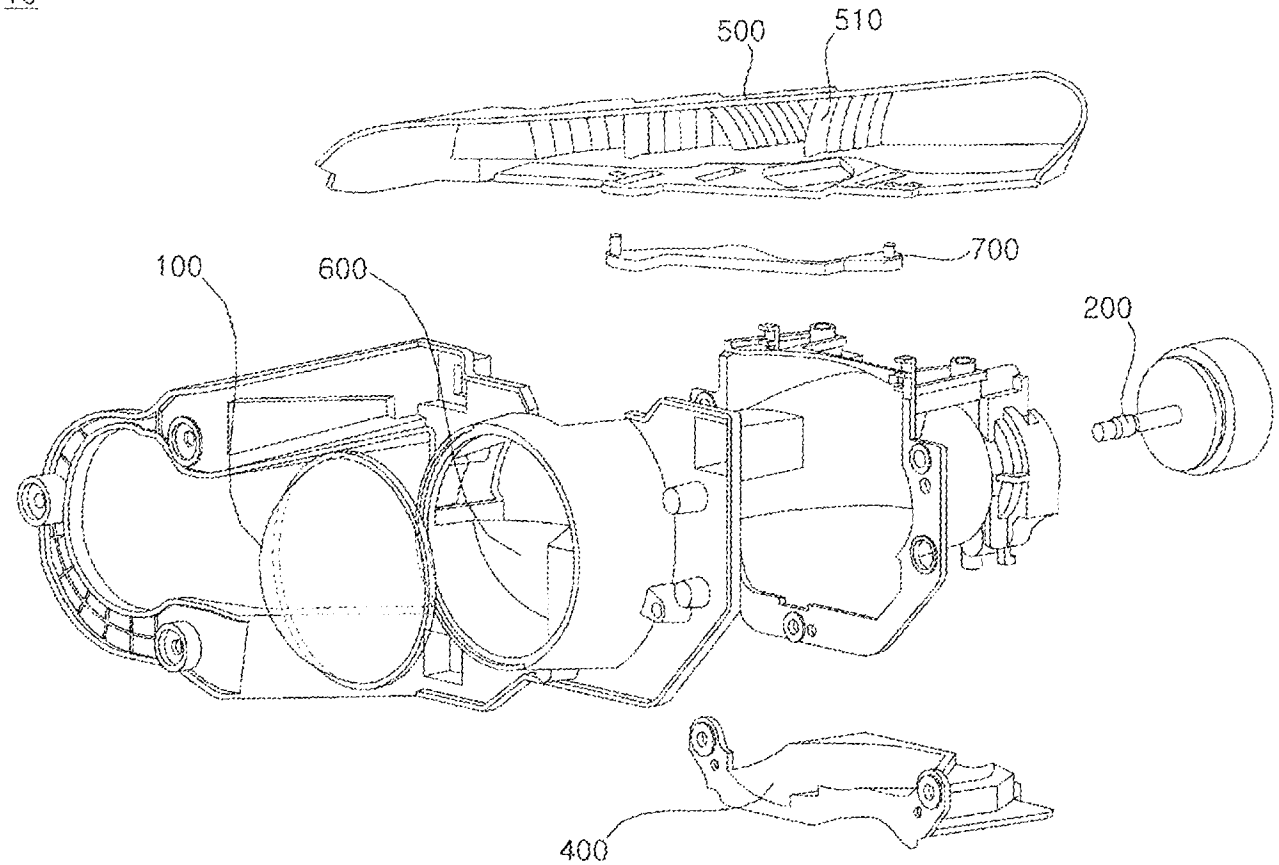
FIG. 2 is an exploded perspective view of a lamp device for a vehicle according to an exemplary embodiment of the present invention.
Figure 3:
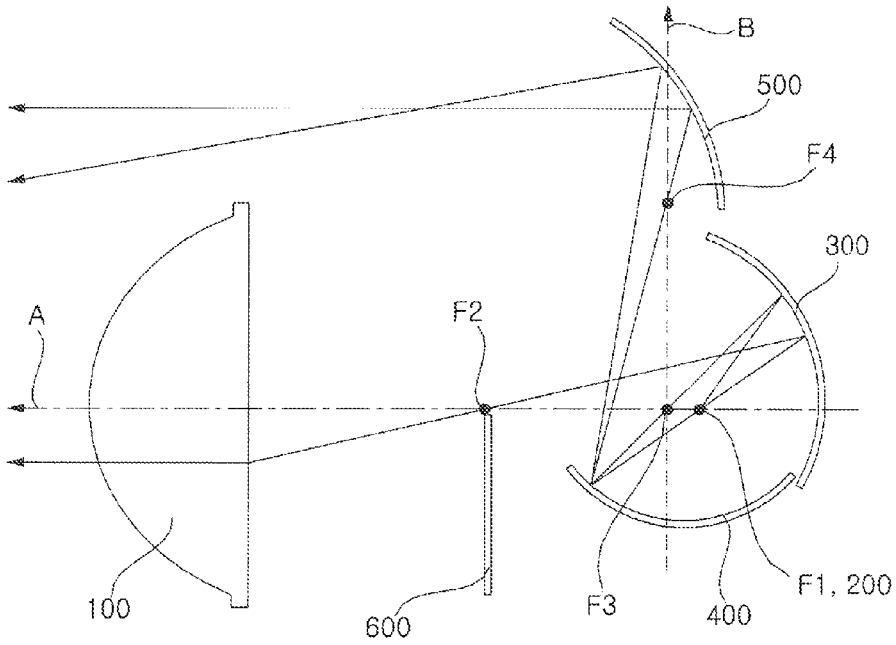
FIG. 3 is a side sectional view schematically illustrating a side section of a lamp device for a vehicle according to an exemplary embodiment of the present invention.
Figure 4:
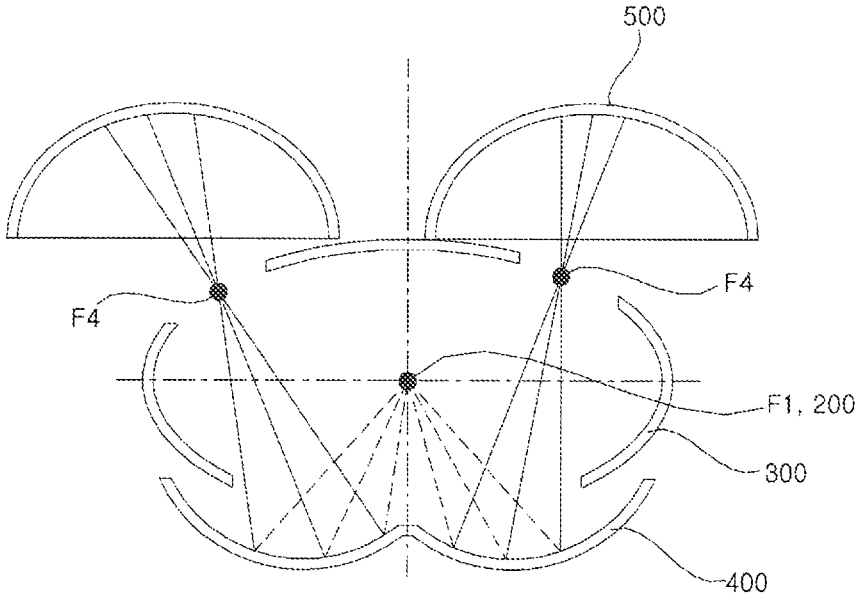
FIG. 4 is a frontal view schematically illustrating a front of a lamp device for a vehicle according to an exemplary embodiment of the present invention.
Figure 5:
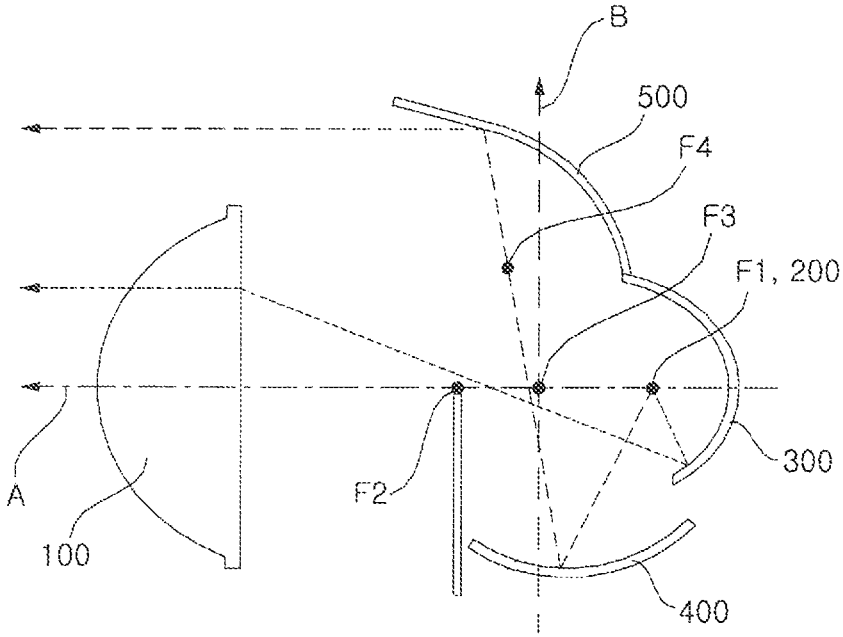
FIG. 5 is a side sectional view schematically illustrating a side section of a lamp device for a vehicle according to another exemplary embodiment of the present invention.

FIG. 1 is a perspective view of a lamp device for a vehicle according to an exemplary embodiment of the present invention. FIG. 2 is an exploded perspective view of a lamp device for a vehicle according to an exemplary embodiment of the present invention. FIG. 3 is a side sectional view schematically illustrating an optical system of a lamp device for a vehicle according to an exemplary embodiment of the present invention. FIG. 4 is a frontal view schematically illustrating a front of a lamp device for a vehicle according to an exemplary embodiment of the present invention. FIG. 5 is a side sectional view schematically illustrating a side section of a lamp device for a vehicle according to another exemplary embodiment of the present invention.

Referring to FIGS. 1 to 5, a lamp device 10 for a vehicle according to an exemplary embodiment of the present invention includes a lens 100, a light source 200, a main reflector 300, a lower sub reflector 400, an upper sub reflector 500, a shield plate 600, and a filter 700.

The lens 100 is disposed on a first optical axis A extending toward the front and rear of a vehicle, and refracts and transmits light. The lens 100 may be aspherically formed. The aspheric lens 100 may transmit light which passes a second focus F2 of a main reflector (described below) directly forward. The lens 100 may be formed of a transparent glass or plastic material. In general, the first optical axis A may pass through the center of the aspheric lens 100.

The light source 200 is disposed on a first focus F1 (described below) and emits light in all directions. The light source 200 may be formed as a light emitting diode (LED). This is because an LED generates a large amount of light with a small amount of power.

The light source 200 is disposed between the main reflector 300 and the lens 100, and is disposed at the rear of the shield plate 600. That is, the light source 200 is disposed on the first focus F1 (described below).

The main reflector 300 is disposed at the rear side of the lens 100 and reflects light forward. The main reflector 300 has the first focus F1 provided on the first optical axis A.

The main reflector 300 has the second focus F2 of the main reflector 300 provided at the front of the first focus F1. As described above, the light source 200 is disposed on the first focus F1, and as will be described, the shield plate 600 is disposed correspondingly on the second focus F2.

The light emitted at the main reflector 300 may be reflected and pass the second focus F2 of the main reflector 300 and then proceed directly to the front of the vehicle while passing the lens 100.

The lower sub reflector 400 is disposed at the bottom of the light source 200. The lower sub reflector 400 upwardly reflects light emitted from the light source 200.

The lower sub reflector 400 has a first focus F3 at a point where the first optical axis A intersects with a second optical axis B extending upward and downward from the vehicle. The first focus F3 of the lower sub reflector 400 is disposed apart to the front more than the first focus F1 of the main reflector 300. Also, the second optical axis B may vertically intersect the first optical axis A.

A second focus F4 of the lower sub reflector 400 is disposed above the first focus F3 of the lower sub reflector 400. Also, the filter 700 may be disposed on the second focus F4 of the lower sub reflector 400. Further, the lower sub reflector 400 in the present exemplary embodiment is provided with the second focus F4 of the lower sub reflector 400 on the second optical axis B. However, as illustrated in FIG. 5, the lower sub reflector 400 according to other embodiments of the present invention may not be provided with the second focus F4 on the second optical axis B.

The upper sub reflector 500 is disposed above the light source 200. The upper sub reflector 500 reflects the light reflected by the lower sub reflector 400 forward. The upper sub reflector 500 is formed in plurality.

The upper sub reflector 500 includes a plurality of reflective surfaces 510 having different reflective angles. The plurality of reflective surfaces 510 may reflect the light reflected by the lower sub reflector 400 in lateral directions to the front of the vehicle. Thus, the short-range lateral light width may be increased to increase the visibility of the driver.

The upper sub reflector 500 reflects the light passing through the second focus F4 of the lower sub reflector 400 to be parallel to the first optical axis A. Also, the upper sub reflector 500 reflects light that does not pass through the second focus F4 of the lower sub reflector 400 to the front and bottom.

The shield plate 600 is disposed between the lens 100 and the light source 200. The shield plate 600 is disposed to correspond to the second focus F2 of the main reflector 300. The shield plate 600 performs the function of blocking light thereto.

The filter 700 is disposed between the lower sub reflector 400 and the upper sub reflector 500. The filter 700 performs color compensation for the light reflected by the lower sub reflector 400. The filter 700, as described above, may be disposed on the second focus F4 of the lower sub filter 400.

The function of the lamp device 10 for a vehicle according to the above-configured present invention will be described below.

When the lamp device is lit while a vehicle travels, light emitted from the light source 200 is reflected to the front of the vehicle by the main reflector 300. The reflected light passes the second focus F2 of the main reflector 300, and the light that passes the second focus F2 of the main reflector 300 is refracted and transmitted by the lens 100 directly to the front of the vehicle.

Also, the light emitted by the light source 200 is reflected upward by the lower sub reflector 400, and the light that passes the second focus F4 of the lower sub reflector 400, is relayed directly to the front of the vehicle by the upper sub reflector 500. That is, the light is reflected to travel in parallel to the first optical axis A.

However, the light that does not pass the second focus F4 of the lower sub reflector 400 is emitted downward to the front of the vehicle by the upper sub reflector 500.

Light is emitted in a wide lateral range to the front of the vehicle by means of the plurality of reflective surfaces 510 with different reflected angles of light from the upper sub reflector 500.

Therefore, the light efficiency of the light emitted by the light source 200 may be improved, and the lamp device 10 for a vehicle may be provided to secure the field of vision for the driver by emitting light in a wide lateral range to the front of the vehicle.

In the above, while exemplary embodiments of the present invention have been illustrated and described, the present invention is not limited to the specific embodiments described above, and various modified embodiments are possible by those having ordinary skill in the technical field to which the present invention pertains without departing from the spirit of the present invention as defined by the scope of the claims, and such modified embodiments should not be interpreted as lying outside of the technical concept or the outlook of the present invention.

What is claimed is:

1. A lamp device for a vehicle, comprising:

a lens disposed on a first optical axis extending in a front and rear direction of the vehicle, and refracting and transmitting light;

a main reflector disposed at a rear side of the lens, reflecting light frontward, and including a first focus (F1) and second focus (F2) spaced frontward from the first focus (F1) on the first optical axis;

a light source disposed on the first focus of the main reflector, and emitting light;

a lower sub reflector disposed below the light source, upwardly reflecting the light emitted directly from the light source, and including a first focus (F3) on a point at which the first optical axis and a second optical axis extending in an up and down direction of the vehicle intersect and a second focus (F4) spaced upward from the first focus (F3);

an upper sub reflector disposed above the light source, and frontwardly-reflecting the light reflected by the lower sub reflector, wherein the light passing the second focus (F4) of the lower sub reflector is reflected frontward in direction parallel to the first optical axis; and a shield plate disposed between the lens and the light source, and disposed to correspond to a second focus of the main reflector, wherein the first focus of the lower sub reflector is disposed apart to the front more than the first focus of the main reflector.

2. The lamp device for a vehicle of claim 1, wherein the second optical axis perpendicularly intersects the first optical axis.

3. The lamp device for a vehicle of claim 1, wherein the lens is formed aspherically.

4. The lamp device for a vehicle of claim 1, wherein the light source is formed as an LED.

5. The lamp device for a vehicle of claim 1, wherein the upper sub reflector is formed in plurality.

6. The lamp device for a vehicle of claim 1, wherein the upper sub reflector frontwardly and downwardly reflects light that does not pass the second focus of the lower sub reflector.

7. The lamp device for a vehicle of claim 1, further comprising:

a filter disposed between the lower sub reflector and the upper sub reflector, and compensating for the light reflected by the lower sub reflector.

8. An apparatus comprising:

a light source;

a lens arranged at a distance from the light source that refracts light emitted from the light source;

a back reflector to reflect light emitted from the light source towards the lens and then refracted by the lens;

a lower reflector that reflects light directly received from the light source and the back reflector; and at least one upper reflector that reflects light received from the light source and the lower reflector, wherein the lens is arranged on a first optical axis that refracts light emitted from the light source and light reflected off of the back reflector to distribute light refracted by the lens into a plurality of light beams substantially parallel to the first optical axis, a first focus point of the rear reflector is positioned at the light source on the first optical axis, a second focus point of the rear reflector is positioned between the light source and the lens on the first optical axis, a third focus point of the lower reflector is positioned between the first focus point of the rear reflector and the second focus point of the rear reflector on the first optical axis, and a fourth focus point of the lower reflector is positioned directly above the third focus point of the lower reflector on a second optical axis, wherein the second optical axis is perpendicular to the first optical axis and intersects the first optical axis at the third focus point of the lower reflector.

9. The apparatus of claim 8, wherein the apparatus is a lamp device for a vehicle.

10. The apparatus of claim 9, wherein the first optical axis extends through both the front direction and the rear direction of the vehicle such that the light refracted by the lens is directed in the front direction of the vehicle.

11. The apparatus of claim 8, wherein the light source emits light from the first focus point of the rear reflector which then:

reflects light off of the rear reflector to the lower reflector through the third focus point of the lower reflector;

reflects light off of the lower reflector to the at least one upper reflector through the fourth focus point of the upper reflector; and reflects light off of the at least one upper reflector in a direction substantially parallel to the first optical axis above the lens.

12. The apparatus of claim 8, wherein the light source emits light from the first focus point of the rear reflector which then:

reflects light from the light source off of the rear reflector to the lower reflector;

reflects light reflected from the rear reflector off of the lower reflector to the at least one upper reflector; and reflects light reflected from the lower reflector off of the at least one upper reflector in a direction above the lens that is at an angle with the first optical axis.

13. The apparatus of claim 12, wherein:

the direction different than the first optical axis comprises a plurality of directions which scatters a portion of the light emitted from the light source to supplement the plurality of light beams substantially parallel to the first optical axis; and the direction different than the first optical axis directs light in a downward direction.

14. The apparatus of claim 13, wherein the direction different than the first optical axis provides a diversified light field in the front of a vehicle comprising the apparatus.

15. The apparatus of claim 12, wherein the light reflected from the at least one upper reflector in a direction different than the first optical axis does not pass through the fourth focus point of the upper reflector.

16. The apparatus of claim 8, wherein the light source comprises at least one light emitting diode (LED).

17. The apparatus of claim 8, wherein the lens has an aspheric shape configured to refract light in a direction parallel to the first optical axis.

18. The apparatus of claim 8, wherein the at least one upper reflector comprises a plurality of upper reflectors.

* * * * *